US012607190B2

(12) United States Patent
Jones et al.

(10) Patent No.: US 12,607,190 B2
(45) Date of Patent: Apr. 21, 2026

(54) PUMP WITH A MODULAR CONSTRUCTION

(71) Applicant: Vitesco Technologies Germany GmbH, Regensburg (DE)

(72) Inventors: Sigismund Jones, Neu-Anspach (DE); Christian Böhm, Bad Vilbel (DE)

(73) Assignee: Vitesco Technologies Germany GmbH, Regensburg (DE)

( * ) Notice: Subject to any disclaimer, the term of this patent is extended or adjusted under 35 U.S.C. 154(b) by 29 days.

(21) Appl. No.: 18/598,541

(22) Filed: Mar. 7, 2024

(65) Prior Publication Data

US 2024/0309873 A1 Sep. 19, 2024

Related U.S. Application Data

(63) Continuation of application No. PCT/EP2022/074887, filed on Sep. 7, 2022.

(30) Foreign Application Priority Data

Sep. 10, 2021 (DE) ..... 10 2021 210 043.0

(51) Int. Cl.
*F04D 13/06* (2006.01)
*F04C 23/00* (2006.01)
*F04D 15/00* (2006.01)

(52) U.S. Cl.
CPC ..... *F04D 13/0686* (2013.01); *F04C 23/008* (2013.01); *F04D 15/0066* (2013.01); *F04C 2240/30* (2013.01)

(58) Field of Classification Search
CPC ..... F04D 13/0686; F04D 15/0066; F04C 2240/30; F04C 2240/808; F04C 2240/81;
(Continued)

(56) References Cited

U.S. PATENT DOCUMENTS 5,605,448 A 2/1997 Martin, Sr.
6,126,407 A * 10/2000 Guentert ..... F02M 39/005 417/244
(Continued)

FOREIGN PATENT DOCUMENTS

DE 102017210426 A1 * 12/2018 ..... F04C 15/0096
EP 2878823 A1 6/2015
(Continued)

OTHER PUBLICATIONS

DE102017210426 English translation (Year: 2025).*
(Continued)

*Primary Examiner* — Dominick L Plakkoottam

(57) ABSTRACT

A pump, such as a transmission oil pump, is disclosed. The pump includes an electric motor having a motor housing with a housing wall, and a pump device having a pump housing. A drive shaft of the electric motor is coupled to the pump device. The pump also includes an electrics housing with a motor controller for controlling the electric motor. The electrics housing is detachably attached to the pump housing on a side of the pump housing that faces away from the electric motor. The housing wall of the motor housing is designed as a bearing plate and is detachably arranged on the motor housing rim of the motor housing in the region of a groove which encircles the rim of the bearing plate. The pump housing is detachably arranged by an edge encircling the inside of the pump housing rim, on the bearing plate of the electric motor.

14 Claims, 3 Drawing Sheets

(58) Field of Classification Search
CPC .... F04C 18/3441; F04C 23/008; F04C 25/02; F01C 21/10
See application file for complete search history.

(56) References Cited

U.S. PATENT DOCUMENTS

| | | | | |
|---|---|---|---|---|
| 6,287,090 | B1 * | 9/2001 | Hamasaki | F04C 15/0049 417/360 |
| 2014/0294625 | A1 * | 10/2014 | Tucker | B60G 17/0195 310/68 B |
| 2016/0377082 | A1 * | 12/2016 | Fecke | H02K 1/2706 417/420 |

FOREIGN PATENT DOCUMENTS

| | | | | |
|---|---|---|---|---|
| JP | 2000154791 | A | | 6/2000 |
| JP | 2007282429 | A | * | 10/2007 |
| JP | 2019052589 | A | | 4/2019 |
| WO | 9739514 | A1 | | 10/1997 |
| WO | 2013139628 | A1 | | 9/2013 |

OTHER PUBLICATIONS

European Search Report dated Dec. 22, 2022 for corresponding European Patent Application No. PCT/EP2022/074887.
German Search Report dated May 3, 2022 for corresponding Patent Application No. 10 2021 210 043.0.
Japanese Office Action dated Apr. 3, 2025 for corresponding Patent Application No. 2024-515572.

* cited by examiner

PUMP WITH A MODULAR CONSTRUCTION

CROSS-REFERENCE TO RELATED APPLICATIONS

This application claims the benefit of PCT Application PCT/EP2022/074887, filed Sep. 7, 2022, which claims priority to German Application 10 2021 210 043.0, filed Sep. 10, 2021. The disclosures of the above applications are incorporated herein by reference.

TECHNICAL FIELD

The disclosure relates to a pump, such as a transmission oil pump. The pump includes a pump device, a pump housing, an electric motor having a drive shaft coupled to the pump device, a rotary position encoder connected to a shaft end of the drive shaft, a motor controller controlling the electric motor, and a rotary position sensor connected to the motor controller.

BACKGROUND

Known solutions for attaching an electronics system and a magnet, which is used as a rotary position encoder, in an electric transmission oil pump with an integrated electronics system and sensor-based control include the following two options. In one solution, the electronics system into which the rotary position sensor (slave) is integrated is flange-connected to the electric motor. The magnetic rotary position encoder is directly placed on the motor shaft in the vicinity of the rotary position sensor. It has been found to be disadvantageous that the electronics system heats up undesirably. As an alternative solution, it is known that the electronics system, which is used to control the electric motor, is flange-connected to the pump device. In this known solution, the electric motor and possibly the pump device are located between the electronics system, which serves for motor control, on the one hand and the rotary position encoder and rotary position sensor on the other hand; since the rotary position sensor is thus arranged far away from the electronics system, it requires complex means to be electrically connected to the electronics system.

DE 10 2017 210 426 A1 represents a further development of the known solutions. This known solution describes a pump, such as a transmission oil pump, that includes a pump device and a pump housing bordering at least one pump chamber fluidically connected to the pump device. Furthermore, the pump includes an electric motor, the drive shaft of which is coupled to the pump device, a rotary position encoder which is connected to a shaft end of the drive shaft, a motor controller for controlling the electric motor, and a rotary position sensor which is connected to the motor controller. The rotary position encoder and the shaft end of the drive shaft are accommodated rotatably in the pump housing here. Furthermore, a control circuit of the motor controller and the rotary position sensor are arranged adjacent to the pump housing which accommodates the rotary position encoder. This arrangement is intended to allow improved cooling of the electronics system which serves to control the electric motor. This ensures the most compact possible construction of the pump and the lowest possible susceptibility to faults in the controller with respect to external magnetic fields. Furthermore, it is thus possible to achieve the smallest possible distance with low tolerances between the rotary position encoder and the rotary position sensor and also accurate detection of the rotary position of the drive shaft of the electric motor by way of the rotary position sensor which interacts with the rotary position encoder for this purpose.

The electric motor housing is centered in relation to the pump housing here with the aid of the stator, more precisely on the winding head of the stator. This is generally difficult because wires and contact elements and, if appropriate, the encapsulation of the stator are normally in the way. Under certain circumstances, the laminated core of the stator has to project far into the pump housing in order to allow adequate centering. However, this increases the axial height of the arrangement.

A particular disadvantage with this arrangement of the electric motor or housing of the electric motor and the pump or pump housing is therefore that, after final assembly, the drive shaft, the rotor of the electric motor and the rotor of the pump may not be optimally aligned with each other. This firstly has a negative effect on the property of the magnetic field of the motor. Secondly, a pump rotor that is not optimally aligned leads to eccentricities in the pressure chambers of the pump and thus increased radial forces have to be compensated for by bearings of appropriate size.

As a rule, the bearing plate, which is designed as a housing wall of the electric motor housing, also has to be aligned with the stator of the electric motor.

SUMMARY

Against this background, the disclosure advantageously provides a pump of the generic type. Above all, the disclosure provides an improved assembly and disassembly, where a coaxiality of the individual components of the pump in the assembled state is increased, while the number of components is reduced at the same time.

In order to solve the problem, the disclosure proposes that a housing wall of the motor housing designed as a bearing plate is detachably arranged on the rim of the motor housing in the region of a groove which encircles the rim of the bearing plate, and in that at the same time the pump housing is likewise detachably arranged by way of an edge, which encircles the inside of the rim of the pump housing, on the bearing plate of the electric motor. This has several advantages. The alignment of the motor and the pump device occurs on the bearing plate. The bearing plate of the motor housing firstly serves to center the essential components of the pump. Secondly, the bearing plate serves as a bearing for the drive shaft in this region, as a result of which the number of components and thus costs can be reduced. This also reduces the tolerance chain with respect to possible misalignment, such as of the drive shaft in the pump. Overall, an increase in coaxiality is achieved in the arrangement of the components of the pump.

Implementations of the disclosure may include one or more of the following optional features. In some implementations, the drive shaft is guided through a hole in a housing wall which is arranged between the electric motor and the pump device, where meandering structures or geometries of different shape are formed on the inner side of the hole and/or on the outer side, which is situated in the hole, of the shaft. This housing wall may be the bearing plate. By way of the meandering structures or by way of geometries of suitably different shape, leakage oil may be fed from the pump to the electric motor in order to cool it due to the pressure from a vane pump, for example, of 40 bar. In addition to the motor being cooled, the shaft and the plain bearing are lubricated too. The electrical connection between the electric motor and the electronics system/ controller may be free of the fluid, such as oil, to be pumped. This design configuration provides a very short connection between the electric motor and its electronics system which serves for control.

In some examples, a rotary position encoder is connected to a shaft end of the drive shaft, such as the shaft end of the drive shaft are rotatably accommodated in the pump housing. A rotary position sensor is connected to the motor controller, The rotary position encoder, a control circuit, and the rotary position sensor are arranged adjacent to the pump housing, which accommodates the rotary position encoder.

The disclosure provides several advantages. Firstly, an arrangement of the motor controller in relation to the pump chamber, which borders the pump housing, as closely adjacent as possible promotes dissipation of heat from the motor controller, such as from a commutation circuit, into the pump housing and from there promotes the discharge of heat by the pumped fluid (preferably oil). Secondly, in conjunction with this, the advantage is also achieved that the rotary position sensor can be located only a short distance from the rotary position encoder and at the same time in the vicinity the motor controller. The rotary position sensor can generate an accurate sensor signal which is dependent on the position of the rotary position encoder that changes continuously during operation. This allows for a construction which is simple and at the same time insensitive to interfering influences, for example in relation to external magnetic fields on the rotary position sensor, with simple and space-saving design, such as when using cost-effective materials, at the same time. It is also possible to achieve a design with which the pump is easy to assemble and disassemble.

A distance between the rotary position sensor and the rotary position encoder may be in the range of a few millimeters. Since a small distance can be selected between the rotary position encoder and the rotary position sensor, tolerances which are dependent on the size of the distance can also be reduced. In some examples, this distance is, infinitely variably, adjustable in order to obtain the best-possible sensor signal. High accuracy of the rotary position detection of the drive shaft can thus be achieved. Instead of a rotary position, this could also be referred to as a rotational position.

In some examples, the pump may be an oil pump, such as a transmission oil pump. However, the use is not limited to this, but rather applications for all pumpable liquid media come into consideration, such as an application as a water pump for example.

In some implementations, the pump housing is of modular design, i.e., forms a housing module of the pump. The pump housing may be arranged between a motor housing and an electrics housing. The pump housing can represent an interface between the pump device and its suction-side and pressure-side pump chambers on the one hand and the electronics system on the other. Firstly, the pump housing can, for example together with the bearing plate of the electric motor, border a pump space, which represents a wet space, for the pump device and its pump chambers and at the same time, for example together with an electrics housing, delimit an electronics space, which represents a dry space, for the electronics system or for the controller of the electric motor. In this respect, the pump housing is a multifunctional modular pump housing. The fact that the pump housing also serves to border the electronics space, that is to say also serves functionally as an electronics housing, can make the entire construction and assembly/disassembly easier and more cost-effective. Due to the spatial proximity between the rotary position sensor and the controller, the additional complex connection between the electronics system and the sensor system required in the prior art can be dispensed with. Since the electronics system or the controller of the electric motor can be cooled by way of the pumped fluid (preferably oil) due to its small distance from the pump chamber or chambers of the pump device, a separate cooling system for the power electronics that is otherwise required can be dispensed with. This also contributes to a simpler and cheaper construction and more favorable assembly/disassembly. Another advantage is that the sensor system, which includes the rotary position encoder and the rotary position sensor, can be selected and arranged such that no second printed circuit board, which is separate from the controller, or no extra electronic connection is required for it. The distance between the rotary position sensor and the electronics system or controller can be shortened by way of the electronics system or controller being arranged in an electronics installation space which is bordered by the pump housing. The electronics installation space can be separated from the pump space by a wall of the pump housing.

The motor controller and the rotary position sensor are preferably arranged on a side of a wall of the pump housing that faces away from the electric motor, the wall bordering the pump chamber. It is possible that a distance between components of a control circuit of the motor controller and a wall of the pump housing that faces away from the electric motor and borders the pump chamber lies in the range of a few millimeters or is less than one millimeter. As the distance decreases and particularly if this distance is entirely eliminated, the transfer of heat from the motor controller to the pump housing and the fluid, such as oil, conveyed therein can be promoted and as a result cooling of the motor controller can be achieved. The pump chamber may be a pressure chamber (as a pressure-side pump chamber) of the pumped fluid, such as of oil, which is fluidically connected to the pump device.

In some implementations, the drive shaft extends through at least one component of the pump device that can be driven by the drive shaft. This promotes a desired small distance between the rotary position encoder and thus the rotary position sensor from the controller of the electric motor. The rotary position sensor may be mounted on a printed circuit board on which a control circuit of the motor controller is located. In some examples, the rotary position encoder is fastened to the front of the shaft end of the drive shaft. The rotary position encoder, such as a magnetic rotary position encoder, can be mounted on the drive shaft on the pump side (wet space). The rotary position sensor (slave) can be located inside the dry electronics space in the housing. The rotary position encoder can be retrofitted on the drive shaft, that is to say fitted after the drive shaft has been guided through components of the pump device. As a result, the rotary position encoder can have larger dimensions, in particular a larger diameter, than the passage of smallest cross section in the pump device. As a result, the radial extent of the pump can be of compact design even when the rotary position sensor has comparatively large dimensions.

In some implementations, the rotary position encoder is a permanent magnet and the rotary position sensor is a magnetic field sensor. Owing to the possibility of retrofitting, the magnet can be large enough to generate a sufficiently strong magnetic field. In order to firstly allow exact axial positioning of the magnet and to simplify subsequent disassembly of the pump, the magnet may be guided or held in an additional element. This element, which can be referred to as a magnet housing, may have a similar coefficient of expansion to the drive shaft at the interface to the drive shaft. This allows a secure, non-positive connection (such as a press-fit) of the magnetic rotary position encoder to the drive shaft. In order to keep the tolerances of the axial position of the magnetic rotary position encoder in relation to the adjacent pump housing small, the magnet housing can be pressed onto the drive shaft to a degree during assembly. In addition, the obtained degree of freedom in the magnet size makes it possible to use a more cost-effective magnet material (for example samarium cobalt). Since the pump can have small dimensions in the radial direction, the friction torque of the pump can also be kept low.

The rotary position sensor is positioned such that an imaginary linear extension of the drive shaft leads geometrically through the rotary position sensor. The wall of the pump housing that faces away from the electric motor and borders the pump space is of thinner-walled design in a region between the rotary position sensor and the rotary position encoder than in laterally adjoining wall regions and has a thickness of less than two millimeters. In some examples, the rotary position sensor and the control circuit are mounted on a printed circuit board together. The printed circuit board may be a PCB or, for example, a ceramic circuit carrier or, for example, a flex film or, for example, a rigid flex film.

In order to promote removal of heat from the power electronics system of the control circuit, the printed circuit board is arranged such that the rotary position sensor and/or at least one electrical or electronic component of the control circuit and/or at least one other electrical or electronic component which is arranged on the printed circuit board and/or at least one surface region of the printed circuit board that is parallel to the circuit plane is in heat-transmitting direct or indirect contact with a wall of the pump housing that faces away from the electric motor and borders the pump chamber. The printed circuit board can be populated, for example, with transistors, such as MOSFETs, or other electrical and/or electronic components. It is also possible to populate the printed circuit board on both sides, for example, in such a way that components are in the same position on the two opposite sides of the printed circuit board.

In some implementations, a heat conductor is applied in a heat-transmitting manner to the outer side of the wall of the pump housing that faces away from the electric motor and borders the pump chamber. The heat conductor is a solid or a pasty or a liquid heat conductor. The rotary position sensor and/or at least one electrical or electronic component of the control circuit and/or at least another electrical or electronic component arranged on the printed circuit board and/or at least one surface region of the printed circuit board that is parallel to the circuit plane is in heat-transmitting contact with the heat conductor. The heat conductor may be a thermally conductive adhesive. In conjunction with this, a sealing adhesive can be applied, as a result of which sealing of the electronics system in relation to the pump housing and in relation to the environment can be achieved. The use of a thermally conductive adhesive and a sealing adhesive for drawing heat from the power electronics system makes it possible in the case of cured adhesive material for the fastening elements, such as screws, rivets or the like for example, that are otherwise required to be omitted. This also contributes to space and process savings.

The outer side of the wall of the pump housing that faces the printed circuit board and borders the pump chamber can have a dome-like projection or several dome-like projections. One or more dome-like projections can promote the transfer of heat from the control circuit, the printed circuit board or other electrical/electronic components populated with it/them to the wall of the pump housing that borders the pump chamber. The controller or power electronics system, in combination with a rotary position sensor that is selected to be insensitive to electronic field influences, allows all of the electronic components to be cooled, for example, to be optimally cooled within a small installation space (due to the possible small dimensions of the pump) when the printed circuit board is populated on both sides, which are virtually parallel one above the other. Heat can be drawn from the power electronics system by way of a thermally conductive adhesive in conjunction with an additional sealing adhesive (sealing off the electronics system in relation to the pump housing and the environment).

In some examples, the pump device can be a vane pump device. This likewise promotes a space-saving construction of the pump. As an alternative, use of a different type of pump, for example a G-rotor, would be possible.

In some implementations, one projection or several projections can extend into the pump chamber from the pump housing, where the projection or the projections is or are designed in such a way that a laminar or a turbulent flow is promoted in the pump chamber during operation. In this way, a type of flow that is suitable for cooling can be activated, and therefore the flow can be referred to as an active laminar or an active turbulent flow. The projection or projections can be configured and arranged such that a type of flow that is suitable for transporting heat is produced. At least one dome-like, such as an annular, projection is formed. The pump housing can be produced using a casting process, such as using a die-casting process. The material used is, for example, aluminum, but other materials may also be used. Since the pump housing is of modular design and can be exchanged for another pump housing on the pump if required, it is possible, depending on requirements (for example, on the cooling capacity), to select a pump housing with a suitable geometry, with suitable projections projecting into the pressure space. In this respect, different pump housings can be manufactured, for example by way of arranging or by omitting exchangeable inserts in the casting tool. In this way, a pump housing can be provided, which meets the existing requirements in individual cases and enables effective drawing of heat from the controller, especially a commutation circuit. Owing to the possible adaptation of the cooling dome geometry in connection with exchangeable inserts, it is possible to achieve a scalability of, for example, 700 W at present to, for example, an estimated 1500 W pump power with the same overall construction of the electric pump with variation of different power semiconductors and higher electric currents caused by this. It is possible to adjust a relatively long laminated core in the electric motor if necessary. This is possible with a modular design.

The electric motor may be a, single-phase or three-phase, brushless DC motor. In some examples, the control circuit includes power electronics, such as a commutation circuit, where the commutation circuit has, a B2 bridge or a B6 bridge or an electrical circuit such as neutral point circuit or full bridge. The commutation circuit can have, for example, transistors, capacitors, resistors, coils, etc. as components.

As has already been explained, both the pump and the pump housing are of modular design. The pump housing is detachably attached to the bearing plate of the electric motor and an electrics housing is detachably attached to the pump housing on a side of the pump housing that faces away from the electric motor. The bearing plate and pump housing can delimit a pump space that represents a wet space, and the pump housing and electrics housing can delimit an electronics space that represents a dry space. In some examples, the phase lines of the electric motor exit the pump at the highest point in the radial direction and there are guided parallel to the motor axis in the direction of the controller. A detachable or a non-detachable connection element may selectively be inserted between the motor and the electronics system. The pump device may include a pressure plate having a passage opening through which the drive shaft extends. An assembly includes the rotary position encoder, which is a permanent magnet, and a magnet housing having a diameter which is greater than a passage opening diameter in the pressure plate. In some examples, the magnet has at least a certain diameter to achieve a sufficiently strong magnetic field. A magnet diameter may be greater than 7.5 millimeters. However, a correspondingly large passage (passage opening) in the pressure plate (for assembly with pre-installed magnets) reduces the sealing surface between the pump rotor and the plate, or if the sealing surface is the same, the pump would become radially larger and would thus obtain less favorable friction radii. The resolution of this conflict of objectives between a small passage opening diameter (passage diameter) and a large magnet diameter is achieved by the possibility of retrofitting the magnet described in this application.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
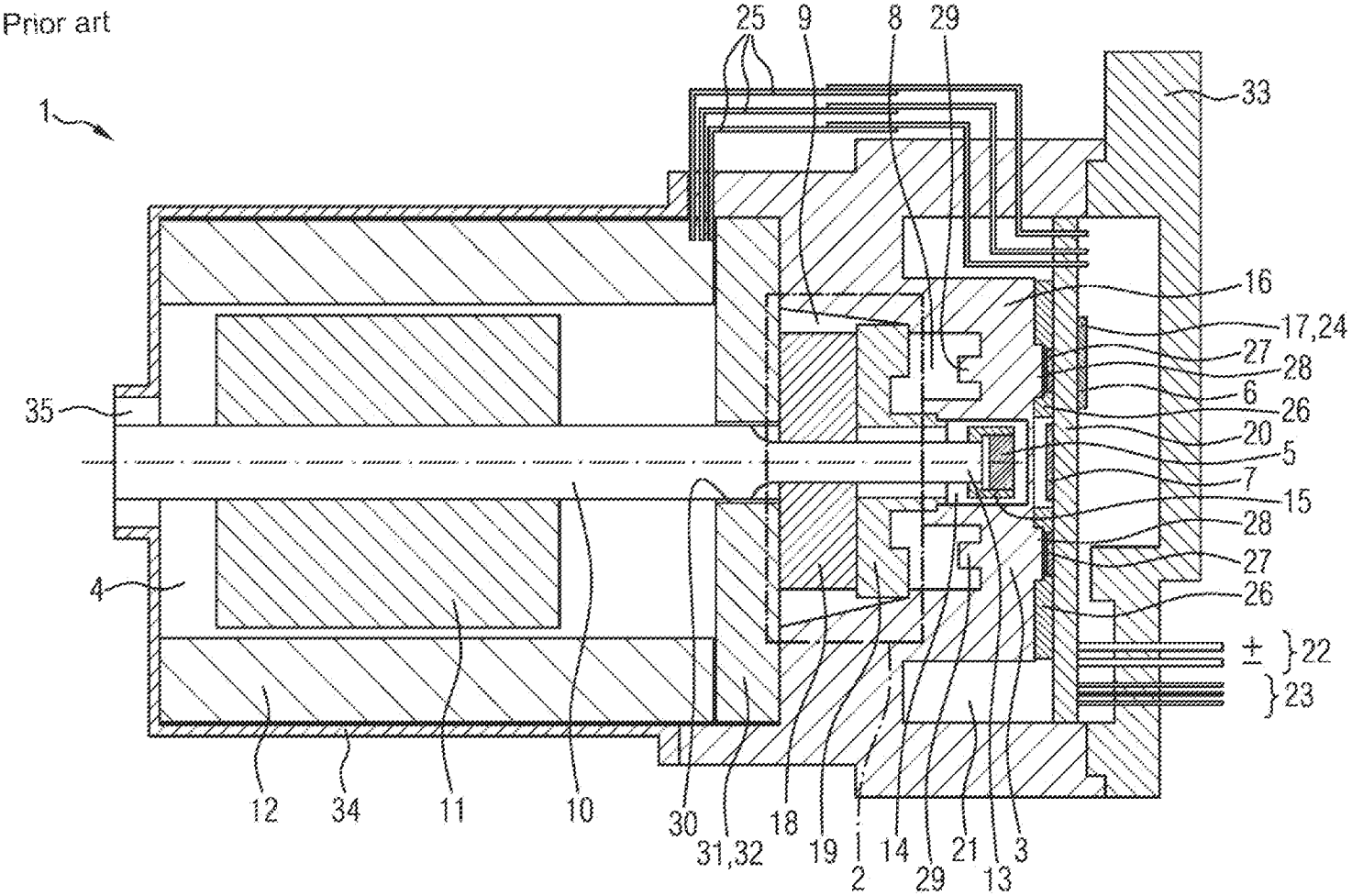
FIG 1 Prior art
FIG. 1 schematically shows a sectional view of a pump in accordance with the prior art.

A pump 1 from the prior art is presented with reference to FIG. 1. The pump is a transmission oil pump, as can be used for a motor vehicle for example. The pump 1 includes a pump device 2, a pump housing 3, an electric motor 4, a rotary position encoder 5, a motor controller 6 for controlling the electric motor 4, and a rotary position sensor 7. The pump device 2 has a vane pump device 18 and a pressure plate 19. The pump housing 3 borders the pump device 2. A pressure-side pump chamber 8 is fluidically connected to the pump device, and a suction-side pump chamber 9 is fluidically connected to the pump device 2. In the example, the electric motor 4 is a three-phase, brushless DC motor which includes a drive shaft 10, a rotor 11 connected to the drive shaft, and a stator 12 cylindrically surrounding the rotor. The drive shaft 10 is connected in a rotationally rigid manner to a rotating cylinder, not shown in the schematic illustration of FIG. 1, of the vane pump device 18 for the transmission of torque. The rotary position encoder 5, which is a permanent magnet in the example, is fastened to the front of a shaft end 13 of the drive shaft 10, which is rotatable in the pump housing in a hole 14 of slightly larger diameter. Accordingly, the rotary position sensor 7 is a magnetic field sensor. The rotary position encoder 5, which is a permanent magnet, is fixed in a cylindrical magnet housing 15, which is pressed onto the shaft end 13 by way of a press-fit, so that a desired axial distance between the end wall of the hole 14 and the surface of the rotary position encoder 5 which faces it can be adjusted here. The shaft end 13 of the drive shaft 10 and the rotary position encoder 5 which is fastened to the front of the shaft end are rotatably accommodated in the hole 14 in the pump housing 3. The motor controller 6 and the rotary position sensor 7 are adjacent to a wall 16 of the pump housing 3 that faces away from the electric motor 4, the hole 14 being located in the wall.

So that the shaft end 13 can be located in the hole 14, which is adjacent to the rotary position sensor 7, in the wall 16, the drive shaft 10 extends through components of the pump device 2 that can be driven by the drive shaft. In the example, the driveable components are at least one rotatable cylinder (rotor) which forms radial guides in which rotary vanes are arranged in a sliding manner. This rotor is (or, if necessary, several rotors are) located within the only schematically reproduced and in this respect hatched vane pump device 18. In addition, the drive shaft 10 extends in the direction of its shaft end 13 through the pressure plate 19 and from there further into the hole 14.

The rotary position sensor 7 and the control circuit 17 of the motor controller 6 are mounted on a printed circuit board 20 together. The printed circuit board 20 is inserted into a geometrically matching recess 21 in the pump housing 3 and fastened, in the example adhesively bonded, at its outer rim to the adjacent wall of the pump housing 3. A power supply 22 for the printed circuit board 20 is shown. In addition, signal lines 23 are connected to the printed circuit board 20; these can be used, for example, to supply control signals in order to change the rotation speed of the electric motor 4 or to switch on or switch off the electric motor 4. In FIG. 1, the control circuit 17 includes a commutation circuit 24, which includes a B6 bridge. Accordingly, the electric motor 4 is a three-phase DC motor. The phase lines, all denoted 25, which are connected to the printed circuit board 20 and the control circuit 17 formed on the printed circuit board, start from the three phases U, V, W of the three-phase DC motor. From the description, it follows that the electric motor 4 exhibits sensor-based control.

With continued reference to FIG. 1, a heat conductor 26 is applied to several sections of the outside of the wall 16 of the pump housing 3 that faces away from the electric motor 4 and borders the pressure-side pump chamber 8. The sections in which the heat conductor 26 is applied are selected such that the rotary position sensor 7, as well as two transistors 27 (i.e., MOSFETs) which are arranged on the printed circuit board 20 and also several surface regions of the printed circuit board 20 that are parallel to the circuit plane are in thermally conductive contact with the heat conductor 26 and by way of the heat conductor 26 are also in thermally conductive contact with the wall 16. In this case, the wall 16 has, on its side which faces the printed circuit board 20, dome-like projections 28 to promote the transfer of heat. In the example, it is further provided that, starting from the opposite wall side of the wall 16, a likewise dome-like projection 29 extends into the pressure-side pump chamber 8 to promote in the pressure-side pump chamber a type of flow (laminar or turbulent) that is advantageous for the transfer of heat from the wall 16 to the fluid (not shown in FIG. 1) flowing in the pump chamber 8.

As shown in FIG. 1, the drive shaft 10 is guided through a hole 30 in a housing wall 31 which is arranged between the electric motor 4 and the pump device 2, the housing wall 31 being a bearing plate 32 of the electric motor 4. In the example, meandering recesses (not shown in FIG. 1), which are suitable for supplying leakage fluid from the pump device 2 to the electric motor 4 in order to cool it, are formed on the inner side of the hole 30. As shown, the pump housing 3 is of modular design and has several functions. The pump housing 3 is detachably fastened to the bearing plate 32 of the electric motor 4, and an electrics housing 33 is detachably attached to the pump housing 3 on the side of the pump housing that faces away from the electric motor 4. The electric motor 4 is surrounded by the bearing plate 32 and additionally by a motor housing 34. The drive shaft 10 is mounted in a sliding manner in the hole 30 and in a bearing 35, not shown in any detail, in the motor housing 34.

Figure 2:
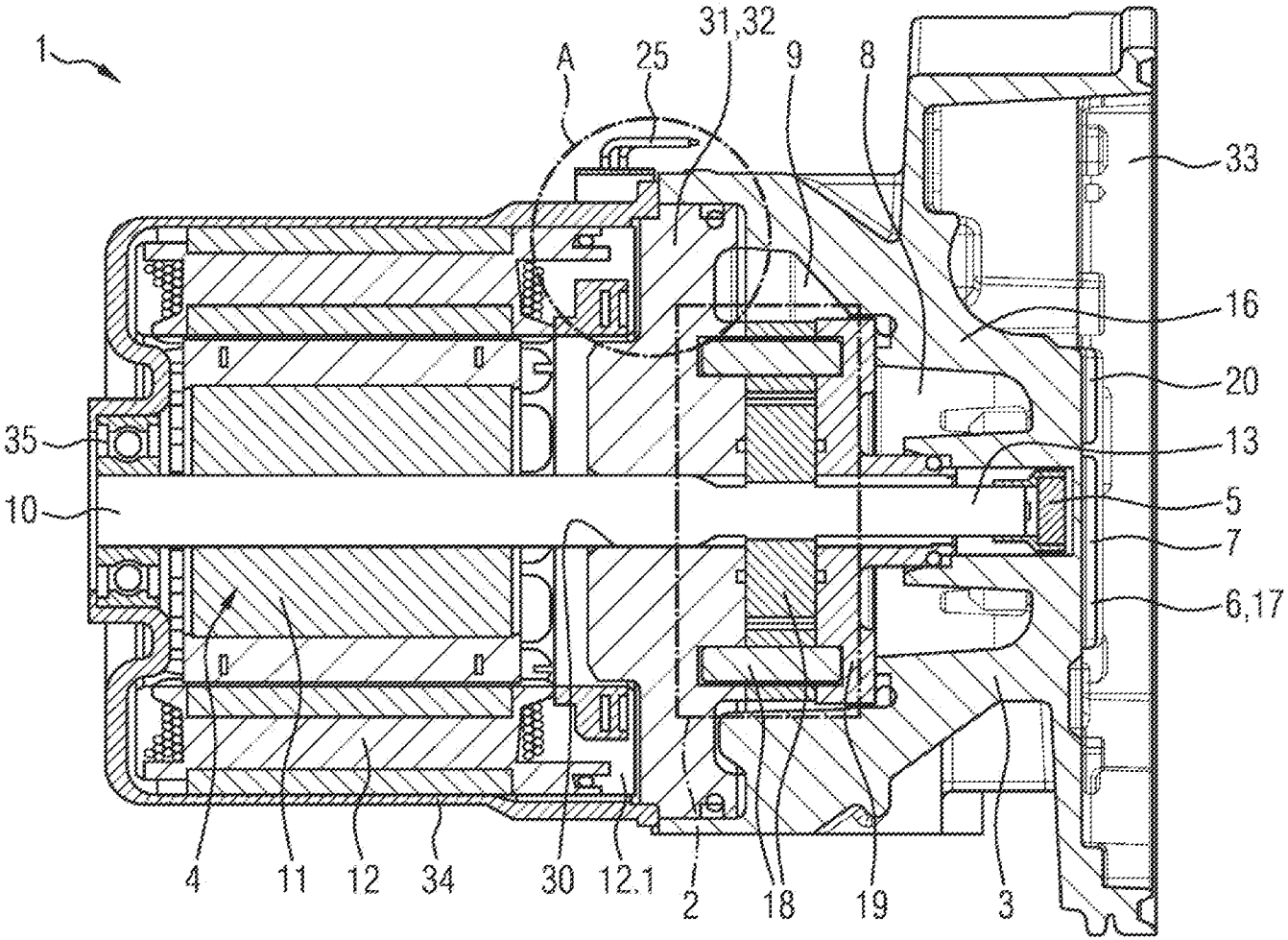
FIG. 2 schematically shows a sectional view of an exemplary pump.

FIG. 2 shows an exemplary pump 1 according to the disclosure. Except for the design of the rim regions of the motor housing 34, of the bearing plate 31 and of the pump housing 3 and of the corresponding relative arrangement of these components in relation to each other, the structure of the pump 1 according to the disclosure in FIG. 2 substantially corresponds to the pump from the prior art in FIG. 1, specifically the projections into the pump spaces 8 and 9 and the individual constituent parts of the electrics housing 33 including their heat-conducting connection to the pump housing 3 not being shown in detail here in FIG. 2.

Figure 3:
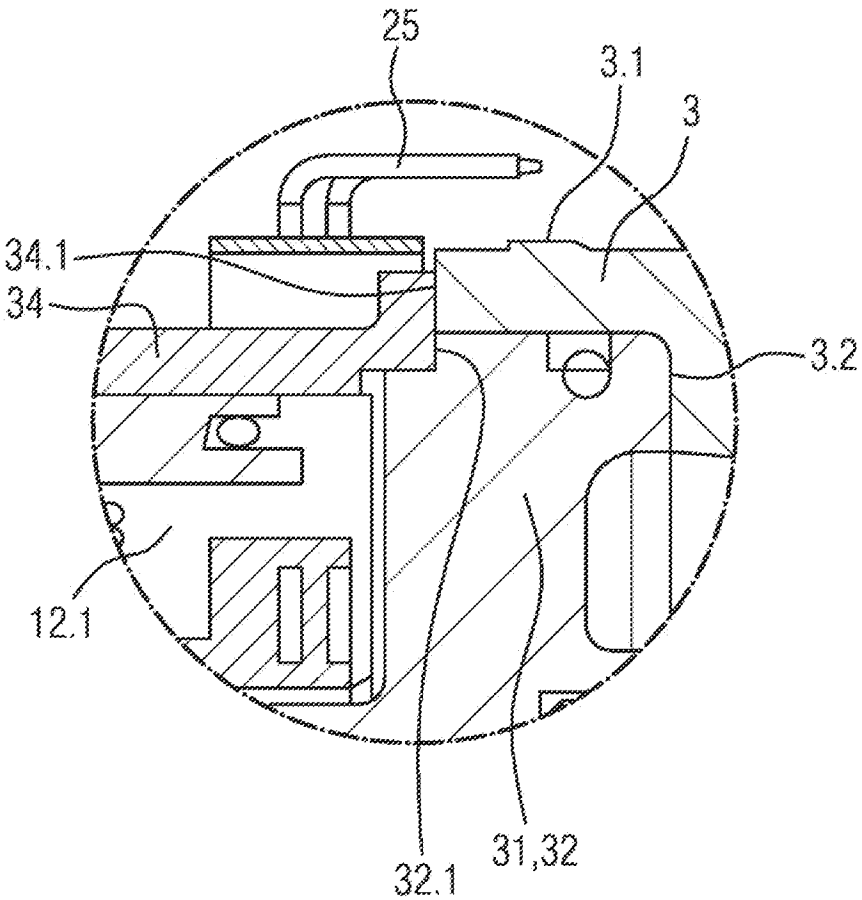
FIG. 3 shows a detail view of portion A from FIG. 2.

FIG. 3 shows section A of FIG. 2. FIG. 3 shows the exemplary design of the rim regions of the motor housing 34, of the bearing plate 31 and of the pump housing 3 and of the corresponding relative arrangement of these components in relation to each other.

The housing wall 31 of the motor housing 34 is designed as a bearing plate 32 and has a circumferential groove 32.1 on its rim which faces the motor housing 34. The bearing plate 32 is detachably arranged in the region of the groove 32.1 on the rim 34.1 of the motor housing 34. The pump housing 3, by way of an edge 3.2 encircling the inside of the rim 3.1 of the pump housing 3, is in turn detachably arranged on the bearing plate 32 on the side of the bearing plate 32 that faces away from the motor housing 34. Thus, during mounting of the components of the pump 1, the bearing plate 32 is the component with which the remaining components are aligned, for example centered. The axial forces that occur after mounting do not act on the stator of the electric motor, but rather are neutralized at the bearing plate 22.

The bearing plate 32 of the motor housing 33 or of the electric motor 4 serves firstly to center the essential components of the pump. Secondly, the bearing plate 32 also serves as a bearing for the drive shaft 10 in this region, as a result of which the number of components and thus costs can be saved, such as by omitting a corresponding bearing. This also reduces the tolerance chain with regard to possible misalignment, such as of the drive shaft 10 in the pump 1. Overall, an increase in coaxiality in the arrangement of the components of the pump according to the disclosure compared to the known prior art is achieved.

A number of implementations have been described. Nevertheless, it will be understood that various modifications may be made without departing from the spirit and scope of the disclosure. Accordingly, other implementations are within the scope of the following claims.

What is claimed is:

1. A pump comprising:

a pump device having a pump housing and a pump housing rim;

an electric motor comprising:

a drive shaft coupled to the pump device, and a motor housing having a housing wall and a motor housing rim, the housing wall includes a bearing plate and a circumferential groove, the housing wall detachably arranged on the motor housing rim in a region of a circumferential groove which encircles a rim of the bearing plate; and a motor controller for controlling the electric motor, the motor controller supported by an electrics housing, the electrics housing is detachably attached to the pump housing on a side of the pump housing that faces away from the electric motor, wherein the pump housing is detachably arranged by way of an edge, which encircles an inside of the pump housing rim, on the bearing plate of the electric motor, and wherein the circumferential groove and a portion of the pump housing adjacent to the circumferential groove are jointly adjacent to the edge of the pump housing.

2. The pump of claim 1, wherein the pump is a transmission oil pump.

3. The pump of claim 1, wherein the drive shaft is guided through a hole in the housing wall which is arranged between the electric motor and the pump device.

4. The pump of claim 1, further comprising:

a rotary position encoder connected to a shaft end of the drive shaft, the shaft end of the drive shaft is rotatably accommodated in the pump housing, the rotary position encoder is supported by the pump housing; and a rotary position sensor connected to the motor controller, wherein the motor controller includes a control circuit, the rotary position sensor and the control circuit are arranged adjacent to the pump housing, which accommodates the rotary position encoder.

5. The pump of claim 4, wherein the motor controller and the rotary position sensor are arranged on a side of a wall of the pump housing that faces away from the electric motor, the wall bordering a pump chamber.

6. The pump of claim 4, wherein the rotary position encoder is fastened to a front of the shaft end of the drive shaft.

7. The pump of claim 4, wherein the rotary position encoder is a permanent magnet and in that the rotary position sensor is a magnetic field sensor.

8. The pump of claim 4, wherein the rotary position sensor is positioned such that an imaginary linear extension of the drive shaft leads geometrically through the rotary position sensor.

9. The pump of claim 4, wherein the rotary position sensor is mounted on a printed circuit board on which the control circuit is located.

10. The pump of claim 4, wherein the rotary position sensor and the control circuit are mounted on a printed circuit board together.

11. The pump of claim 10, wherein the printed circuit board is arranged such that the rotary position sensor and/or at least one electrical or electronic component of the control circuit and/or at least one other electrical or electronic component which is arranged on the printed circuit board and/or at least one surface region of the printed circuit board that is parallel to a circuit plane is in heat-transmitting direct or indirect contact with a wall of the pump housing that faces away from the electric motor and borders a pump chamber.

12. The pump of claim 4, wherein the pump device comprises a pressure plate, the pressure plate has a passage opening through which the drive shaft extends, and wherein the rotary position encoder, which is a permanent magnet, and a magnet housing form an assembly having a diameter greater than a passage diameter of the passage opening of the pressure plate.

13. The pump of claim 1, wherein the drive shaft extends at least through one component of the pump device which can be driven by it.

14. The pump of claim 13, wherein the drive shaft extends at least through an entirety of the pump device.

* * * * *